US011339688B2

(12) United States Patent
Degner et al.

(10) Patent No.: US 11,339,688 B2
(45) Date of Patent: May 24, 2022

(54) VARIABLE CAMSHAFT TIMING VALVE ASSEMBLY

(71) Applicant: BorgWarner, Inc., Auburn Hills, MI (US)

(72) Inventors: Andrew V. Degner, Penn Yan, NY (US); Brian T. Kenyon, McGraw, NY (US); Chad M. McCloy, Cortland, NY (US)

(73) Assignee: BORGWARNER, INC., Auburn Hills, MI (US)

( * ) Notice: Subject to any disclaimer, the term of this patent is extended or adjusted under 35 U.S.C. 154(b) by 0 days.

(21) Appl. No.: 16/775,485

(22) Filed: Jan. 29, 2020

(65) Prior Publication Data

US 2021/0231032 A1 Jul. 29, 2021

(51) Int. Cl.
*F01L 1/34* (2006.01)
*F01L 1/344* (2006.01)

(52) U.S. Cl.
CPC ... *F01L 1/3442* (2013.01); *F01L 2001/34433* (2013.01); *F01L 2001/34443* (2013.01)

(58) Field of Classification Search
CPC ..... F01L 1/3442; F01L 2001/34443; F01L 2001/34433
See application file for complete search history.

(56) References Cited

U.S. PATENT DOCUMENTS 3,724,496 A 4/1973 Secrist
3,901,475 A 8/1975 Dreibelbis
4,256,283 A 3/1981 Reneau et al.
4,257,443 A 3/1981 Turney
4,437,492 A 3/1984 Taylor
4,785,484 A 11/1988 Sargent
4,862,911 A 9/1989 Yie
4,977,927 A 12/1990 Hill
5,048,578 A 9/1991 Dorf et al.
5,404,851 A 4/1995 Neitz et al.
6,267,137 B1 7/2001 Watanabe et al.
6,439,263 B2 8/2002 Schwegler et al.
6,443,421 B1 9/2002 Wolfe
6,510,869 B1 1/2003 Ouchi et al.
6,595,238 B2 7/2003 De Matthaeis
6,799,544 B1 10/2004 Pierik
(Continued)

FOREIGN PATENT DOCUMENTS

EP 0284805 B1 11/1991
EP 0584575 B1 10/1995
(Continued)

OTHER PUBLICATIONS

US 9,764,636 B2, 09/2017, Walter et al. (withdrawn)

*Primary Examiner* — Zelalem Eshete
(74) *Attorney, Agent, or Firm* — Reising Ethington P.C.

(57) ABSTRACT

A valve assembly that can be employed in a variable camshaft timing (VCT) phaser assembly. The valve assembly includes a metal sleeve and a check valve. The check valve, in an implementation, has an integral construction with the metal sleeve. The integral construction has multiple designs, one of which includes an overmolded construction of the check valve with the metal sleeve. The valve assembly can also include a valve housing which, in the implementation of the VCT phaser assembly, is a center bolt.

28 Claims, 8 Drawing Sheets

(56) References Cited

U.S. PATENT DOCUMENTS 6,799,844 B2 10/2004 Leighton et al.
6,834,675 B1 12/2004 Gill
6,899,127 B1 5/2005 Swingley
6,932,038 B2 8/2005 Pierik
6,968,858 B2 11/2005 Kuehn et al.
7,000,580 B1 2/2006 Smith et al.
7,007,708 B2 3/2006 Burke et al.
7,093,612 B2 8/2006 Greene et al.
7,237,569 B2 7/2007 Shieh
7,258,135 B2 8/2007 Haarer et al.
7,261,073 B2 8/2007 Eisenhardt
7,311,118 B2 12/2007 Doutt
7,328,676 B2 2/2008 Schnell et al.
7,392,819 B2 7/2008 Sailer et al.
7,617,806 B2 11/2009 Schmidt et al.
7,681,589 B2 3/2010 Schwegman
7,789,069 B2 9/2010 Rodriguez-Amaya et al.
7,871,251 B2 1/2011 Marino et al.
7,954,510 B2 6/2011 Schwegman
7,975,720 B2 7/2011 Conway
7,978,748 B2 7/2011 Kaiser et al.
7,987,827 B2 8/2011 Fujiyoshi et al.
8,043,186 B2 10/2011 Gresley et al.
8,147,225 B2 4/2012 Kuny
8,327,869 B2 12/2012 Bock et al.
8,499,787 B2 8/2013 Talaski
8,539,976 B1 9/2013 Rodgers, Jr. et al.
8,763,636 B2 7/2014 Buckley et al.
8,776,747 B2 7/2014 Schafer et al.
8,833,389 B2 9/2014 Dziurda et al.
8,844,484 B2 9/2014 Schafer et al.
8,863,713 B2 10/2014 Schafer et al.
8,894,909 B2 11/2014 Izquieta
8,973,544 B2 3/2015 Busse et al.
9,103,455 B2 8/2015 Mohamed
9,194,506 B2 11/2015 Hutzelmann et al.
9,206,713 B2 12/2015 Schafer et al.
9,206,915 B2 12/2015 Croci
9,227,614 B2 * 1/2016 Kajita ..... B60T 8/4872
9,249,843 B2 2/2016 Ari
9,267,397 B2 2/2016 Itoafa et al.
9,279,512 B2 3/2016 Kajita et al.
9,322,419 B2 4/2016 Hutzelmann et al.
9,328,636 B2 5/2016 Kinouchi
9,377,113 B2 6/2016 Caccavo et al.
9,556,963 B2 1/2017 Hartmann et al.
9,581,003 B2 2/2017 Kofoed et al.
9,587,474 B2 3/2017 Entchev et al.
9,604,236 B2 3/2017 Sandahl et al.
9,638,109 B2 5/2017 Watanabe
9,695,716 B2 7/2017 Smith et al.
9,695,948 B2 7/2017 Kienreich et al.
9,803,520 B2 10/2017 Smith et al.
9,828,959 B2 11/2017 Teike et al.
9,879,793 B2 1/2018 Bayrakdar
9,909,463 B2 3/2018 Schulze et al.
10,066,618 B2 9/2018 Warren
10,066,751 B2 9/2018 Seko et al.
10,156,164 B2 12/2018 Schafer et al.
10,161,273 B2 12/2018 Asahi et al.
10,190,726 B2 1/2019 Herman et al.
10,202,878 B2 2/2019 Noguchi et al.
10,215,296 B2 2/2019 Crump
10,273,837 B1 4/2019 Choi et al.
2004/0069352 A1 4/2004 Wieland et al.
2004/0112208 A1 6/2004 Kot, II
2005/0061372 A1 3/2005 McGrath et al.
2005/0121084 A1 6/2005 Andersson
2006/0096562 A1 5/2006 Pluta et al.
2008/0047621 A1 2/2008 Ittlinger et al.
2008/0190492 A1 8/2008 Fuchs et al.
2008/0236671 A1 * 10/2008 Claude ..... F16K 15/00
137/15.18
2008/0289703 A1 11/2008 Penzone, Jr. et al.
2009/0056817 A1 3/2009 Almaraz et al.
2010/0029424 A1 2/2010 Palomaki et al.
2010/0206404 A1 8/2010 Morrison et al.
2011/0011468 A1 1/2011 Nguyen
2012/0012771 A1 1/2012 Korkmaz et al.
2012/0048221 A1 3/2012 Jeon et al.
2012/0222759 A1 9/2012 Knis et al.
2012/0241026 A1 9/2012 Nguyen
2012/0266979 A1 10/2012 Nguyen
2013/0066278 A1 3/2013 Holland
2013/0199636 A1 8/2013 Doh
2014/0048332 A1 2/2014 Schmidt et al.
2014/0196803 A1 7/2014 Gaertner et al.
2014/0261739 A1 9/2014 Fulkerson et al.
2015/0047721 A1 2/2015 Hayles
2015/0129043 A1 5/2015 Hughes et al.
2016/0230612 A1 * 8/2016 Schulze ..... F01L 1/3442
2016/0252184 A1 9/2016 Fulkerson et al.
2016/0281869 A1 9/2016 Smith et al.
2016/0334022 A1 * 11/2016 Koehler ..... F16K 3/26
2017/0138491 A1 5/2017 Hughes et al.
2017/0159835 A1 6/2017 Rouillon et al.
2018/0021540 A1 1/2018 Jeffrey et al.
2018/0073402 A1 3/2018 Smith
2018/0141076 A1 5/2018 Dobizl et al.
2018/0180191 A1 6/2018 Shinoyama
2018/0245488 A1 8/2018 Hamasaki et al.
2018/0259077 A1 9/2018 Shinoyama
2018/0340618 A1 11/2018 Seko et al.
2019/0003557 A1 1/2019 Cobb et al.
2019/0048870 A1 2/2019 Gaertner et al.
2019/0056038 A1 2/2019 Dupré et al.
2019/0072063 A1 3/2019 Blatterer
2019/0107014 A1 4/2019 Smith
2019/0120397 A1 4/2019 Baer et al.
2019/0211789 A1 7/2019 Zankl et al.
2020/0063878 A1 2/2020 Leonov

FOREIGN PATENT DOCUMENTS

EP 1382893 A1 1/2004
EP 1179136 B1 10/2005
EP 1426665 B1 1/2006
EP 1701032 A1 9/2006
EP 1701073 A1 9/2006
EP 1431041 B1 10/2006
EP 1722154 A2 11/2006
EP 1640569 B1 1/2007
EP 1480098 B1 3/2007
EP 1514022 B1 5/2007
EP 1813845 A1 8/2007
EP 1832789 A2 9/2007
EP 1888911 A1 2/2008
EP 1701007 B1 4/2008
EP 1948963 A1 7/2008
EP 1967775 A1 9/2008
EP 1982100 A1 10/2008
EP 1664491 B1 11/2008
EP 2031238 A2 3/2009
EP 1779009 B1 10/2009
EP 2038567 B1 3/2010
EP 2132419 B1 8/2010
EP 1722139 B1 12/2010
EP 1586746 B1 8/2011
EP 1807609 B1 8/2011
EP 2226537 B1 9/2011
EP 2126427 B1 12/2011
EP 2304237 B1 1/2012
EP 2275726 B1 5/2012
EP 2450558 A1 5/2012
EP 2150736 B1 9/2012
EP 1507620 B1 1/2013
EP 2481961 B1 9/2013
EP 2480807 B1 10/2013
EP 2184490 B1 6/2015
EP 2433039 B1 6/2015
EP 3018347 A1 5/2016
EP 2728164 B1 8/2016
EP 2777821 B1 2/2017
EP 3164593 A1 5/2017

(56) References Cited

FOREIGN PATENT DOCUMENTS

| | | | |
|---|---|---|---|
| EP | 3175925 | A1 | 6/2017 |
| EP | 3181238 | A1 | 6/2017 |
| EP | 3187706 | A1 | 7/2017 |
| EP | 3027885 | B1 | 11/2017 |
| EP | 2992189 | B1 | 12/2017 |
| EP | 3259008 | A1 | 12/2017 |
| EP | 2430307 | B1 | 3/2018 |
| EP | 2796673 | B1 | 3/2018 |
| EP | 2290272 | B1 | 5/2018 |
| EP | 2796674 | B1 | 5/2018 |
| EP | 3168511 | B1 | 6/2018 |
| EP | 3362674 | A1 | 8/2018 |
| EP | 3366895 | A1 | 8/2018 |
| EP | 3366960 | A1 | 8/2018 |
| EP | 3426920 | A1 | 1/2019 |
| EP | 3428491 | A1 | 1/2019 |
| EP | 3444510 | A1 | 2/2019 |
| WO | WO2017179825 | A1 | 10/2017 |
| WO | WO2018021758 | A1 | 2/2018 |
| WO | WO2018035201 | A1 | 2/2018 |
| WO | WO2018050881 | A1 | 3/2018 |
| WO | WO2018065235 | A1 | 4/2018 |
| WO | WO2018087085 | A1 | 5/2018 |
| WO | WO2018118031 | A1 | 6/2018 |
| WO | WO2018128601 | A1 | 7/2018 |
| WO | WO2018230644 | A1 | 12/2018 |
| WO | WO2019009769 | A1 | 1/2019 |

* cited by examiner

VARIABLE CAMSHAFT TIMING VALVE ASSEMBLY

TECHNICAL FIELD

The present application relates to valves and, more particularly, to valves that can be used with variable camshaft timing (VCT) technologies equipped on internal combustion engines.

BACKGROUND

In automobiles, internal combustion engines (ICEs) use one or more camshafts to open and close intake and exhaust valves in response to cam lobes selectively actuating valve stems as the camshaft(s) rotate and overcome the force of valve springs that keep the valves seated. The shape and angular position of the cam lobes can impact the operation of the ICE. In the past, the angular position of the camshaft relative to the angular position of the crankshaft was fixed. But it is now possible to vary the angular position of the camshaft relative to the crankshaft using variable camshaft timing (VCT) technologies. VCT technologies can be implemented using VCT devices (sometimes referred to as camshaft phasers) that change the angular position of the camshaft relative to the crankshaft. These camshaft phasers can be hydraulically-actuated.

Valves are employed in VCT devices, as well as elsewhere in ICEs. At a hydraulically-actuated VCT device, for instance, a valve is typically installed at a center bolt in order to regulate the flow of oil thereat. The valve is oftentimes of the check valve type with a ball and a spring working together to open and close the check valve. A sleeve is typically also installed at the center bolt.

SUMMARY

In one implementation, a variable camshaft timing (VCT) valve assembly may include a metal sleeve and a check valve. The metal sleeve extends in an axial direction between a pair of ends. The check valve has a base. The base is located at one of the pair of ends of the metal sleeve. The base has an integral construction with the one of the pair of ends of the metal sleeve.

In another implementation, a valve assembly may be employed in a variable camshaft timing (VCT) phaser assembly or may be employed elsewhere in an internal combustion engine. The valve assembly may include a metal sleeve, a check valve, an overmolded construction, a valve housing, and a male-female mating construction. The metal sleeve has a bore that spans in an axial direction between a first end and a second end. The check valve is located at the first end or the second end of the metal sleeve. The check valve has a base that is composed of a plastic material. The overmolded construction incorporates the plastic material of the check valve's base. The valve housing partially or more encloses the metal sleeve and the check valve. The male-female mating construction is between the valve housing and the metal sleeve. The male-female mating construction precludes relative circumferential rotational movement between the valve housing and the metal sleeve.

In yet another implementation, a variable camshaft timing (VCT) valve assembly may include a metal sleeve, a check valve, an overmolded construction, and a center bolt. The metal sleeve has a first end and a second end. The metal sleeve also has a ball that is carried at an exterior of the metal sleeve near the first end. The check valve is located at the second end of the metal sleeve, and has a base. The base is made of a plastic material. The overmolded construction involves the base and the metal sleeve. The overmolded construction includes an interlocking groove between the base and the metal sleeve. The center bolt partially or more encloses the metal sleeve and the check valve. The center bolt has a slot that resides at an interior of the center bolt. Receipt of the ball in the slot precludes relative circumferential rotational movement between the center bolt and the metal sleeve.

In yet a further implementation, a variable camshaft timing (VCT) valve assembly may include a metal sleeve, a check valve, a valve housing, and a male-female mating construction. The check valve is located at an end of the metal sleeve. The valve housing partially or more encloses the metal sleeve and the check valve. The male-female mating construction is between the valve housing and the metal sleeve. The male-female mating construction precludes relative circumferential rotational movement between the valve housing and the metal sleeve.

DETAILED DESCRIPTION

Multiple embodiments of a valve assembly are described in this description. The valve assemblies can be employed in automotive applications such as in variable camshaft timing (VCT) phaser assemblies equipped on internal combustion engines (ICEs), and can be employed elsewhere on ICEs.

The valve assemblies include, among other components set forth below, a sleeve that is composed of a metal material and a check valve. The sleeve and check valve share an integrated construction, resulting in an overall manufacturing process and procedure that is more efficient and more effective than past valves in similar applications. Furthermore, in several embodiments, the valve assemblies have a construction that pilots and indexes the relative angular orientation between the sleeve and check valve and a valve housing surrounding the sleeve and check valve. Further, as used herein, the terms axially, radially, and circumferentially, and their related grammatical forms, are used in reference to the generally circular and cylindrical shape of the shown valve assembly and some of its components. In this sense, axially refers to a direction that is generally along or parallel to a central axis of the circular and cylindrical shape, radially refers to a direction that is generally along or parallel to a radius of the circular and cylindrical shape, and circumferentially refers to a direction that is generally along or in a similar direction as a circumference of the circular and cylindrical shape.

Figure 1:
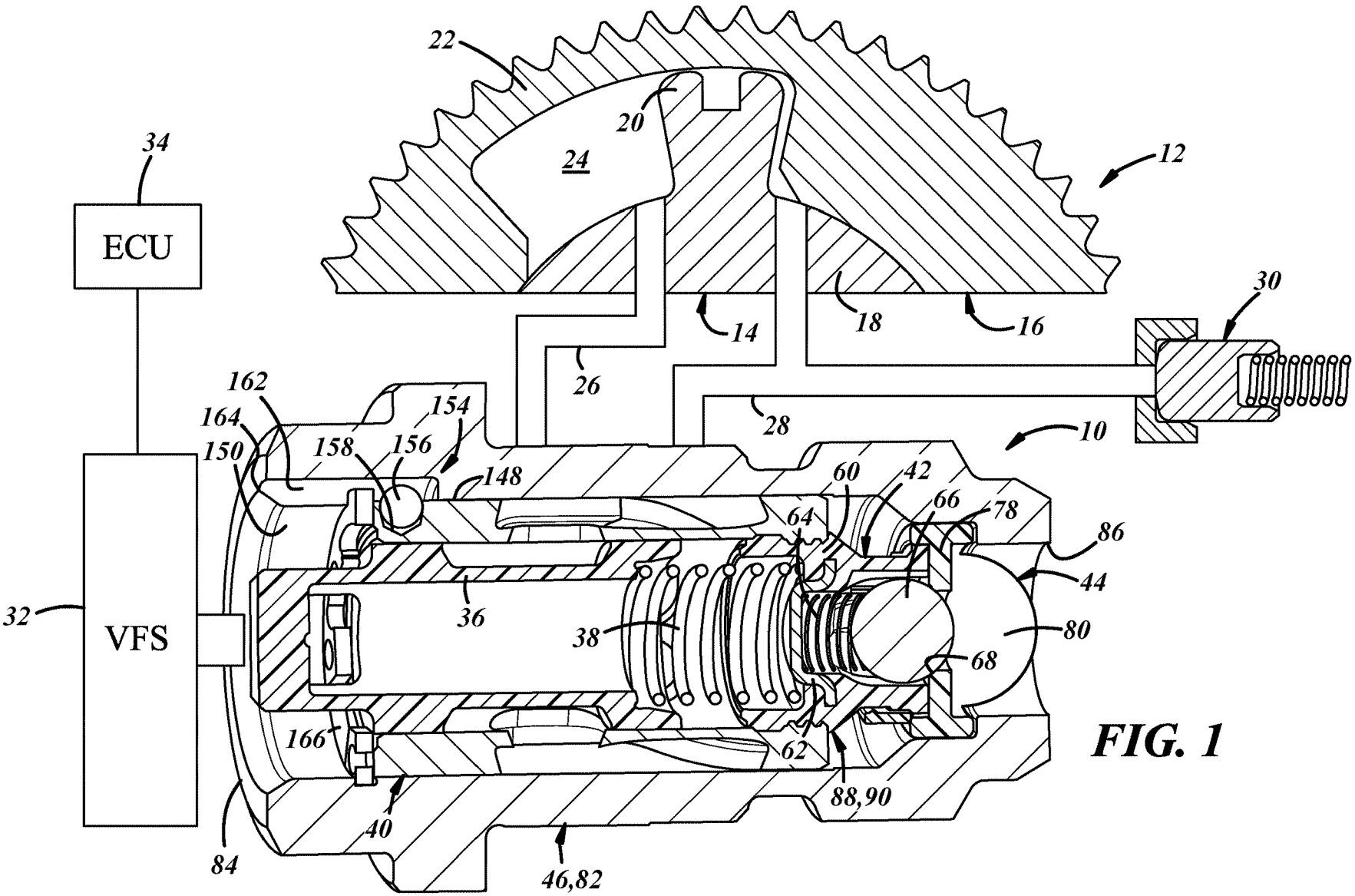
FIG. 1 is a sectional view of an embodiment of a valve assembly that can be employed in a variable camshaft timing (VCT) phaser assembly, and depicts an example of such a VCT phaser assembly.

In the example application of FIG. 1, a valve assembly 10 is employed in a variable camshaft timing (VCT) phaser assembly 12; as mentioned, the valve assembly 10 can be employed in other installations in an automotive internal combustion engine (ICE). The VCT phaser assembly 12 of FIG. 1 is a hydraulically-actuated VCT phaser assembly and, in general, includes a rotor 14 and a housing 16. The rotor 14 has a hub 18 and one or more vanes 20 extending radially-outwardly from the hub 18. The rotor 14 has a rigid connection to a camshaft so that rotation of the rotor 14 causes rotation of the camshaft. The housing 16 can have a camshaft sprocket 22 or a pulley and partly defines fluid chambers 24. An endless loop such as a chain or belt engages the camshaft sprocket 22 or pulley and further engages a crankshaft sprocket of the accompanying ICE. By way of the engagement, rotation of the crankshaft sprocket is transmitted to the housing 16, causing the housing 16 to rotate as well. The vane(s) 20 occupy the fluid chambers 24, and the fluid chambers 24 receive pressurized fluid via lines 26, 28 amid use of the VCT phaser assembly 12. Among its other possible components, the VCT phaser assembly 12 can also include a lock pin assembly 30, a variable force solenoid (VFS) actuator 32, and a controller 34 such as an engine control unit (ECU). The lock pin assembly 30 is used to maintain the angular position of the rotor 14 with respect to the housing 16, and the VFS actuator 32 acts on a spool 36 and moves the spool 36 axially and linearly against the bias of a spring 38 and as commanded by the controller 34. While an example application for the valve assembly 10 has now been described, it should be appreciated that the valve assembly 10 can be employed in other applications including other VCT phaser assemblies with different components and different workings than presented with reference to FIG. 1.

The valve assembly 10 helps manage the flow of fluid at its particular installation. In the example of the VCT phaser assembly 12, the valve assembly 10 manages the flow of fluid to and from the fluid chambers 24 in order to effect advance and retard functionalities of the VCT phaser assembly 12. The valve assembly 10 can have various designs, constructions, and components—many of which are presented as embodiments in the figures—depending on the particular application in which the valve assembly 10 is employed for use. In the embodiments of the figures, the valve assembly 10 includes a metal sleeve 40, a check valve 42, an oil filter assembly 44, and a valve housing 46; still, more, less, and/or different components are possible in other embodiments.

Figure 2:
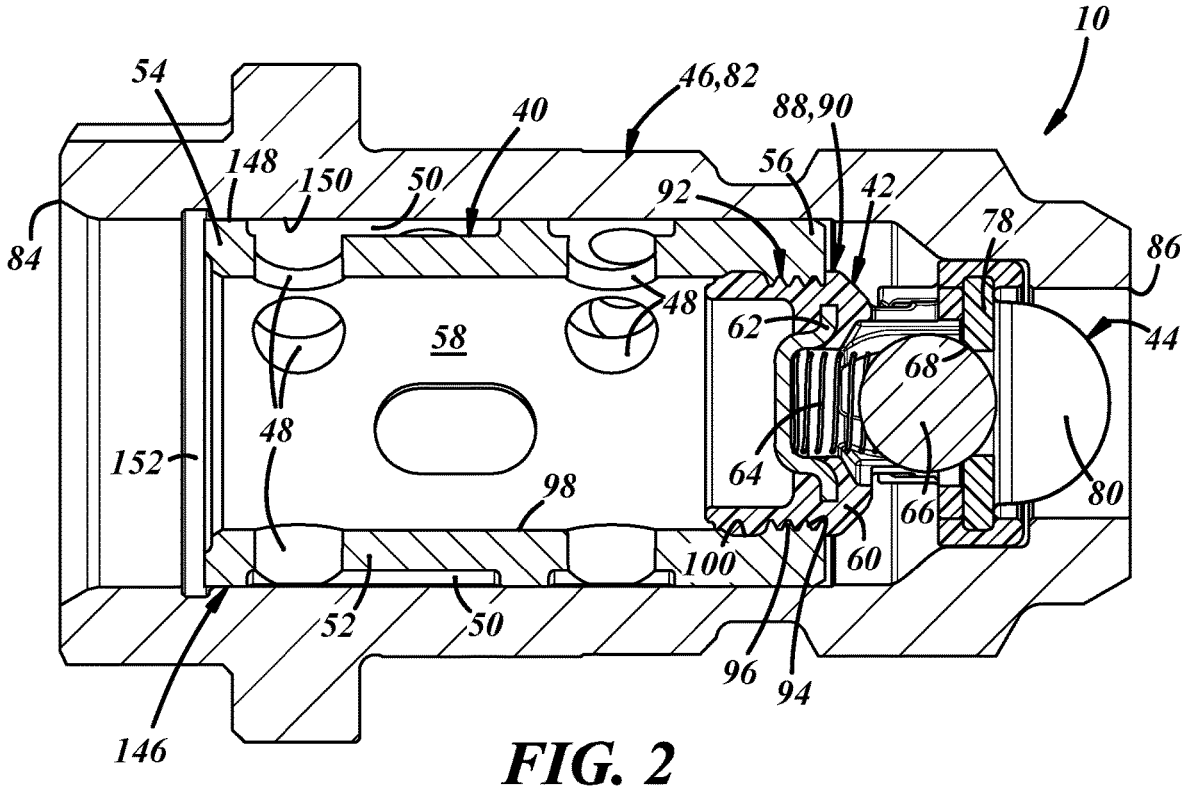
FIG. 2 is a sectional view of another embodiment of a valve assembly.

With reference to FIGS. 1 and 2, the metal sleeve 40 supports the check valve 42 and is received in the valve housing 46. The metal sleeve 40 receives insertion of the spool 36. Ports 48 and passageways 50 reside in a body 52 of the metal sleeve 40 for directing the flow of fluid amid use of the valve assembly 10. The ports 48 and passageways 50 can, at times, fluidly communicate with similar voids in the valve housing 46 and in the spool 36 for the flow of fluid thereamong. The body 52 exhibits a generally cylindrical shape and extends in the axial direction (relative to its cylindrical shape) between a first end 54 and a second end 56. The first and second ends 54, 56 are open ends in this embodiment. A bore 58 is defined at the body's interior and spans between the first and second ends 54, 56. The bore 58 accepts insertion of the spool 36. The metal sleeve 40 is composed wholly of a steel material. In the embodiments presented by the figures, the metal sleeve 40 has a one-piece and monolithic structure, but could be multipiece; in the multipiece example, a metal sleeve component thereof would support the check valve 42.

Maintaining reference to FIGS. 1 and 2, the check valve 42 is held by the metal sleeve 40 and is located at the second end 56. The check valve 42 serves to permit and prevent fluid-flow at its location. The check valve 42 can be of different types in different embodiments, and hence can have various designs, constructions, and components. In the embodiment of the figures, the check valve 42 is a one-way ball check valve and includes an insert or base 60, a retainer 62, a spring 64, and a ball 66. The base 60 carries the retainer 62, and the spring 64 is urged against the retainer 62 and biases the ball 66 in a closed condition against a valve seat 68. In embodiments in which the base 60 is composed of a plastic material, the retainer 62 can be set in the base 60 via an overmolding process, the retainer 62 being composed of a metal material. The ball 66 is displaced from the valve seat 68 and opens the check valve's entry as the result of fluid force that overcomes the spring's biasing force. Fluid flows through the entry and is introduced in the interior of the metal sleeve 40 and to the spool 36, where the fluid is directed further downstream based on the axial and linear position of the spool 36.

The oil filter 44 is held by the check valve 42 upstream of the check valve's entry. The oil filter assembly 44 serves to filter fluid-flow of oil that passes through it prior to the oil proceeding through the check valve's entry. The oil filter assembly 44 can be of different types in different embodiments, and hence can have various designs, constructions, and components. In the embodiment of FIGS. 1 and 2, the oil filter assembly 44 has a frame 78 and a filter 80 in the form of a mesh screen. The frame 78 carries the filter 80 and has a snap-fit coupling with the base 60 of the check valve 42.

The valve housing 46 receives insertion of the metal sleeve 40 and the check valve 42 and the oil filter assembly 44. The valve housing 46 partially or more encloses these components, depending on the particular application. In the application of the VCT phaser assembly 12, the valve housing 46 is a center bolt 82. The center bolt 82 has a cylindrical body extending between a first open end 84 and a second open end 86. Ports (not shown) reside in the body for communicating fluid-flow with the ports 48 and passageways 50 of the metal sleeve 40. The center bolt 82 can have a thread diameter of twenty-two millimeters (M22), or can have a thread diameter of another size.

The metal sleeve 40 and check valve 42 have an integral construction 88 that locates the components together, retains them, and can preclude unwanted separation and movement between them. The integral construction 88 provides an overall manufacturing process and installation procedure that is more efficient and more effective than past valves in similar applications. The integral construction 88 can have various designs, constructions, and components in different embodiments. A first embodiment of the integral construction 88 is depicted in FIGS. 1 and 2. In the first embodiment the integral construction 88 includes an overmolded construction 90. The overmolded construction 90 involves the base 60 of the check valve 42 and an end portion of the metal sleeve 40 adjacent the second end 56. Here, the base 60 is composed of a plastic material that may have a reinforcement such as glass fiber. The plastic base 60 serves as the overmolded material in the overmolding process, while the metal sleeve 40 serves as the substrate in the process. The general steps of the overmolding process for the formation of the overmolded construction 90 can include: placement of the metal sleeve 40 in an injection molding tool, heating the plastic material of the base 60 (e.g., in pellet or another form) to its melting point, injecting the melted plastic material in a liquid state to the molding tool and into and/or onto the metal sleeve 40, and curing or solidifying the plastic material at the metal sleeve 40. The overmolded construction 90, once set, establishes a mechanical interconnection between the metal sleeve 40 and the check valve 42 and precludes and prevents separation between the two in the axial direction (relative to the generally cylindrical shape of the sleeve), precludes and prevents movement between the metal sleeve 40 and the check valve 42 in the circumferential direction (relative to the generally cylindrical shape of the sleeve; i.e., rotational movement), and precludes and prevents movement between the metal sleeve 40 and the check valve 42 in the radial direction (relative to the generally cylindrical shape of the sleeve).

In the first embodiment, and referring now specifically to FIG. 2, the overmolded construction 90 includes an interlocking groove 92 situated between the metal sleeve 40 and the base 60. The interlocking groove 92 mates at the sleeve's interior and, in this embodiment, includes a set of internal threads 94 of the metal sleeve 40 and a set of external threads 96 of the base 60. The internal threads 94 are formed on an inside surface 98 of the body 52 of the metal sleeve 40 and span in the axial direction from the second end 56 and along a small section of the inside surface 98. The external threads 96 are formed as a consequence of the overmolding process of the base 60 and the metal sleeve 40. The external threads 96 are located on an outside surface of the base 60. Furthermore, the overmolded construction 90 of the first embodiment can include a groove 100 that is separate from the threads 94, 96 and that serves to prevent the occurrence of a threading-out of the plastic material of the base 60 amid the overmolding process. The groove 100 is formed fully around the inside surface 98 and resides at an axially offset location with respect to the internal threads 94. Still, in other embodiments the groove 92 could take various forms including the form of a helix shape.

Figure 3:
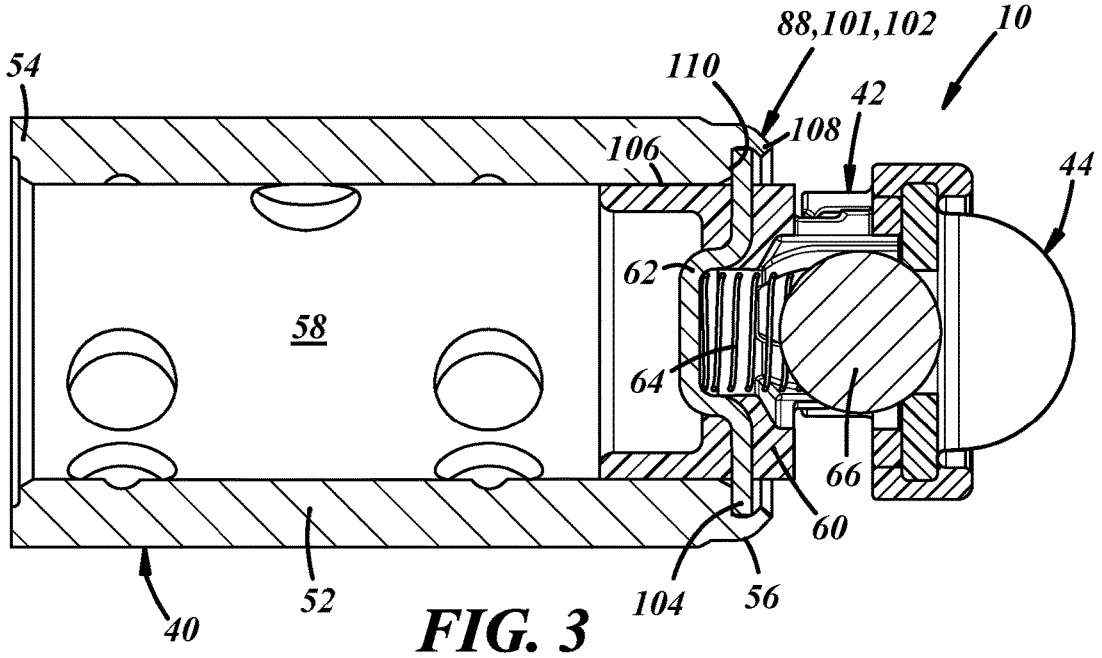
FIG. 3 is a sectional view of another embodiment of a valve assembly.

A second embodiment of the integral construction 88 is depicted in FIG. 3. In the second embodiment the integral construction 88 includes a metal-worked construction 101 in the form of a roll-formed construction 102. The roll-formed construction 102 involves the retainer 62 of the check valve 42 and the end portion of the metal sleeve 40 adjacent the second end 56. Here, the retainer 62 is metal and is overmolded with the plastic base 60. The overmolding process of the retainer 62 and base 60 can be a distinct process from the roll-forming process of the roll-formed construction 102 and can precede it. A free and terminal end 104 of the retainer 62 overhangs a side 106 of the base 60. At the end portion, the metal sleeve 40 has an extension 108 and a recess 110 residing at a bottom or base of the extension 108. Initially, and prior to formation of the roll-formed construction 102 and not illustrated in FIG. 3, the extension 108 can project in the axial direction. In this condition, the check valve 42 can be installed with the metal sleeve 40. The base 60 is inserted into the bore 58 at the second end 56, and the free end 104 is seated in the recess 110. That assembly is then subjected to a metalworking roll-forming process in which the extension 108 is progressively bent radially-inwardly to the degree depicted in FIG. 3. Upon completion of the roll-formed construction 102, the extension 108 is bent over and around the free end 104. The retainer 62 and the base 60 are captured by the extension 108 at the second end 56 of the metal sleeve 40. The retainer 62 and base 60 are hence precluded and prevented from axial separation from the metal sleeve 40, are precluded and prevented from circumferential movement relative to the metal sleeve 40, and are precluded and prevented from radial movement relative to the metal sleeve 40. Still, in other embodiments, the roll-formed construction 102 can involve other portions and parts of the metal sleeve 40 and the check valve 42; for example, an extension of the metal sleeve could capture a part of the plastic base of the check valve. Yet further still, in other embodiments the metal-worked construction 101 may be made from other metal-working processes apart from a roll-forming process.

Figure 4:
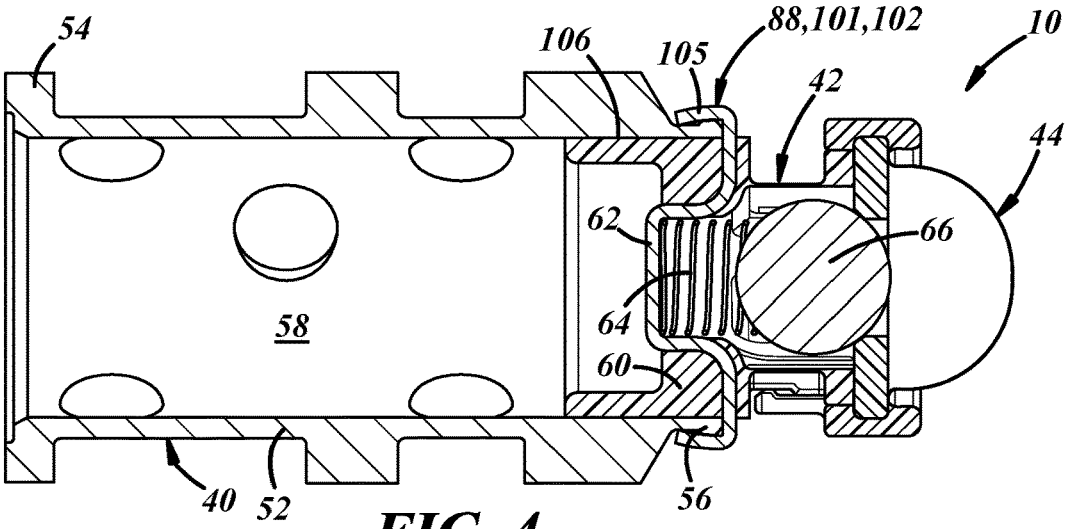
FIG. 4 is a sectional view of another embodiment of a valve assembly.

A third embodiment of the integral construction 88 is depicted in FIG. 4. The third embodiment of the integral construction 88 includes another embodiment of the metal-worked construction 101 and the roll-formed construction 102. As before, the roll-formed construction 102 involves the retainer 62 of the check valve 42 and the end portion of the metal sleeve 40 adjacent the second end 56. The retainer 62 is metal and is overmolded with the plastic base 60. The overmolding process of the retainer 62 and base 60 can be a distinct process from the roll-forming process of the roll-formed construction 102 and can precede it. A free and terminal end portion 105 of the retainer 62 overhangs the side 106 of the base 60. Initially, and prior to formation of the roll-formed construction 102 and not illustrated in FIG. 4, the terminal end portion 105 can project in the radially-outward direction. In this condition, the check valve 42 can be installed with the metal sleeve 40. The base 60 is inserted into the bore 58 at the second end 56, and the terminal end portion 105 is seated against the second end 56. That assembly is then subjected to a metalworking roll-forming process in which the terminal end portion 105 is progressively bent radially-inwardly and axially to the degree depicted in FIG. 4. Upon completion of the roll-formed construction 102, the terminal end portion 105 is bent over and around an outer diameter of the second end 56 and over and around the second end 56 itself. The retainer 62 and base 60 are hence precluded and prevented from axial separation from the metal sleeve 40, are precluded and prevented from circumferential movement relative to the metal sleeve 40, and are precluded and prevented from radial movement relative to the metal sleeve 40. Still, in other embodiments the metal-worked construction 101 may be made from other metal-working processes apart from a roll-forming process.

Figure 5:
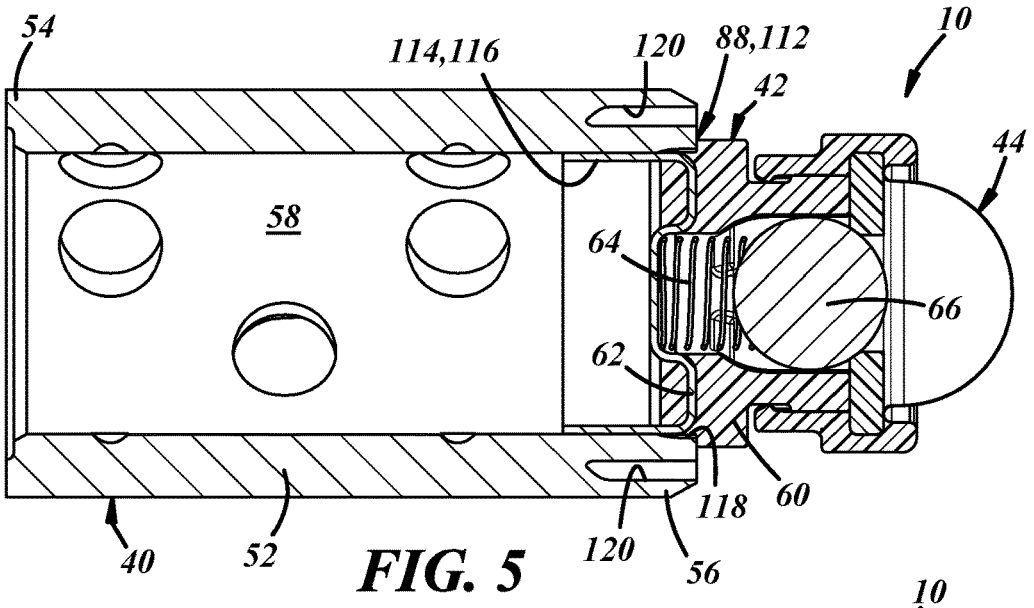
FIG. 5 is a sectional view of another embodiment of a valve assembly.

A fourth embodiment of the integral construction 88 is depicted in FIG. 5. In the fourth embodiment the integral construction 88 includes a press-fit construction 112. The press-fit construction 112 involves the retainer 62 of the check valve 42 and the end portion of the metal sleeve 40 adjacent the second end 56. As before, the retainer 62 is metal and is overmolded with the plastic base 60. Spanning beyond the overmold, the retainer 62 has an end portion 114 in the form of an axially-projecting skirt 116. The end portion 114 is cylindrical in shape. At the second end 56, the metal sleeve 40 has a lead-in 118 of the bore 58 with a slightly increased diameter for easing introduction of the end portion 114 therein. The lead-in 118 spans fully around the circumference of the second end 56. To establish the press-fit construction 112, the end portion 114 is inserted into the bore 58 by way of the lead-in 118 at the second end 56. The end portion 114 is force-fit therein. The press-fit construction 112 can further involve the end portion of the metal sleeve 40 being pressed and physically deformed radially-inwardly against the end portion 114 of the retainer 62. To facilitate the deformation, a relief in the form of a cutout 120 can reside in the second end 56. The resulting deformation can capture the retainer 62 and base 60 against axial separation from the metal sleeve 40 and against relative circumferential movement therebetween.

Figure 6:
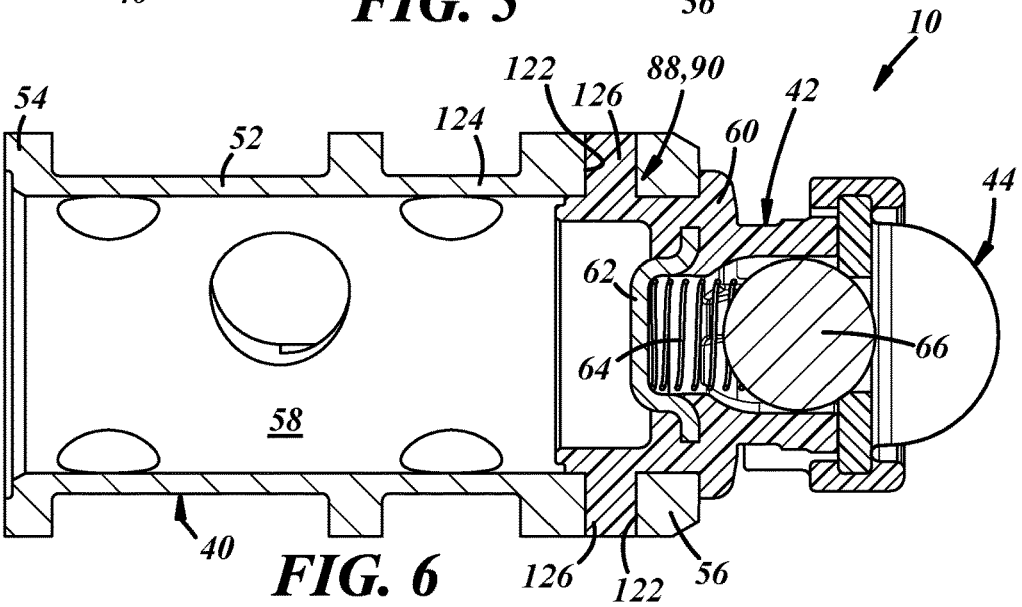
FIG. 6 is a sectional view of another embodiment of a valve assembly.

A fifth embodiment of the integral construction 88 is depicted in FIG. 6. The fifth embodiment of the integral construction 88 includes another embodiment of the overmolded construction 90. As before, the overmolded construction 90 involves the plastic base 60 of the check valve 42 and the end portion of the metal sleeve 40 adjacent the second end 56. The general steps of the overmolding process for the formation of the overmolded construction 90 are the same as previously set forth with reference to the first embodiment. In this fifth embodiment, the overmolded construction 90 includes a projection-hole interconnection between the metal sleeve 40 and the base 60 that precludes and prevents axial separation between the two, that precludes and prevents circumferential movement between the two, and that precludes and prevents radial movement between the two. In the example of FIG. 6 the projection-hole interconnection includes one or more holes 122 residing in a side wall 124 of the body 52 of the metal sleeve 40 and one or more overmolded projections 126 extending from the base 60; still, in other examples the hole(s) could reside in the base and the projection(s) could extend from the metal sleeve. FIG. 6 shows two holes 122 and two complementary overmolded projections 126. The holes 122 span fully through the side wall 124, but need not and could instead span only partially through the side wall 124. The holes 122 can be cylindrical in shape and can be drilled into the side wall 124 or formed in another way. The projections 126 are formed as a consequence of the overmolding process of the base 60 and the metal sleeve 40. The projections 126 extend from a side of the base 60 in a radial direction. Because the projections 126 are a result of the overmolding process, they are received fully within the holes 122.

Figure 7:
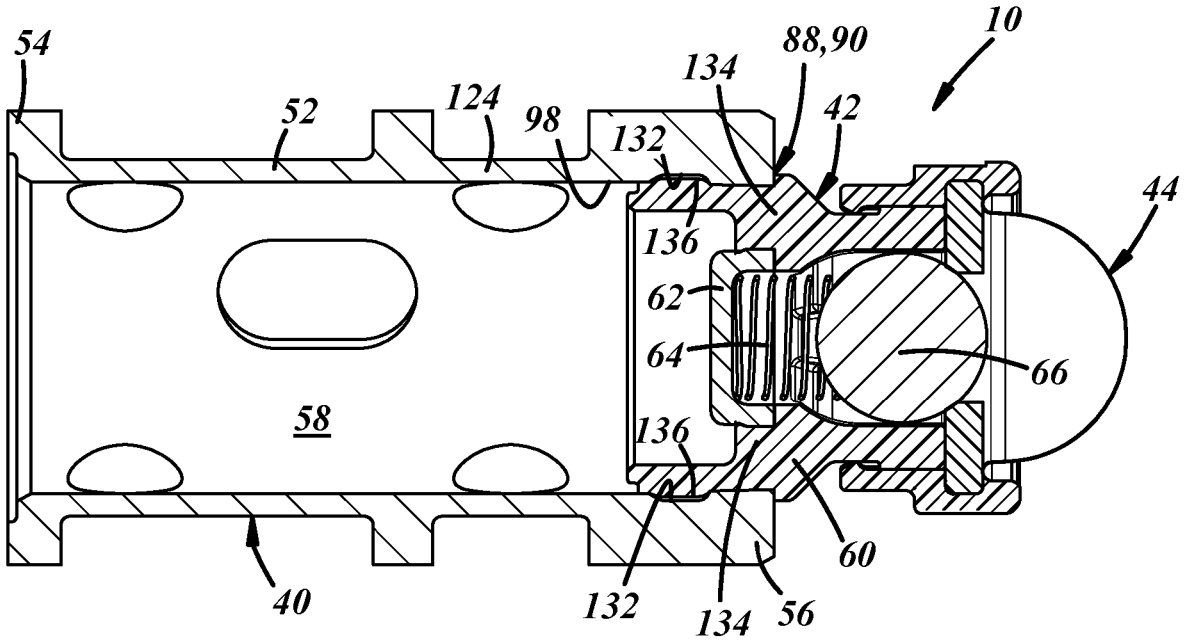
FIG. 7 is a sectional view of another embodiment of a valve assembly.
Figure 8:
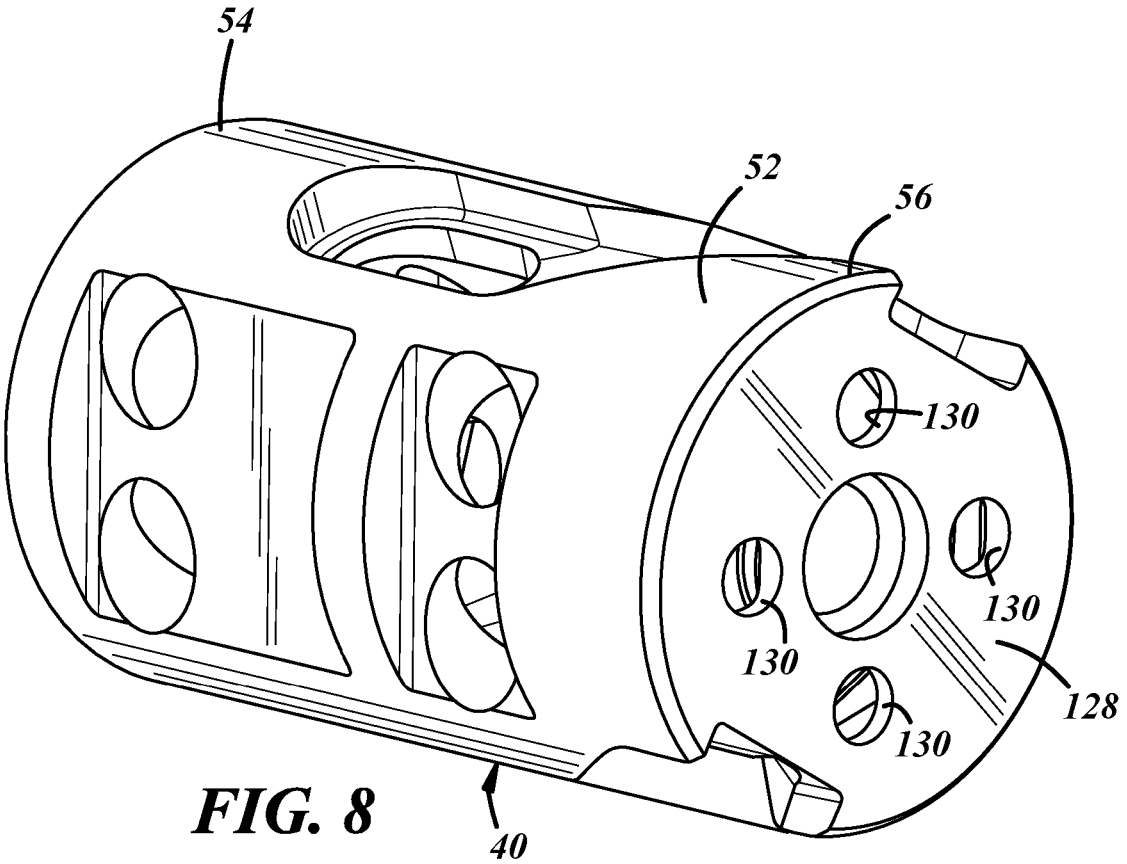
FIG. 8 is a perspective view of a metal sleeve of the valve assembly of FIG. 7.

A sixth embodiment of the integral construction 88 is depicted in FIGS. 7 and 8. In the sixth embodiment the integral construction 88 includes yet another embodiment of the overmolded construction 90. As before, the overmolded construction 90 involves the plastic base 60 of the check valve 42 and the end portion of the metal sleeve 40 adjacent the second end 56. The general steps of the overmolding process for the formation of the overmolded construction 90 are the same as previously set forth with reference to the first embodiment. In this sixth embodiment, the overmolded construction 90 includes another example of the projection-hole interconnection between the metal sleeve 40 and the base 60. This embodiment presents a so-called blind design of the projection-hole interconnection. The second end 56 is a partially closed end and includes an end wall 128 of the metal sleeve 40. A number of holes 130—in this example four—reside in and span fully through the end wall 128. The holes 130 can be drilled into the end wall 128 or formed in another way. Furthermore, one or more recesses 132 reside in the side wall 124 of the body 52 and at the inside surface 98 of the body 52. Overmolded projections 134 are received through the holes 130—one projection 134 for each hole 130. The projections 134 are formed as a consequence of the overmolding process of the base 60 and the metal sleeve 40. The projections 134 extend in the axial direction. Because the projections 134 are a result of the overmolding process, they are received fully within the holes 130. Furthermore, one or more second overmolded projections 136 are received in the recess(es) 132. Like the other projections the second projection(s) 136 is formed as a consequence of the overmolding process of the base 60 and the metal sleeve 40. The second projection(s) 136 extends in the radial direction. Taken together or singly, the holes 130 and projections 134 and the recess(es) 132 and second projection(s) 136 preclude and prevent axial separation between the metal sleeve 40 and the check valve 42, preclude and prevent relative circumferential movement between the metal sleeve 40 and the check valve 42, and preclude and prevent relative radial movement between the metal sleeve 40 and the check valve 42. Moreover, in other embodiments the metal sleeve 40 and base 60 could only include the holes 130 and projections 134 and could then lack the recess(es) 132 and second projections(s) 136, or could only include the recess(es) 132 and second projection(s) 136 and could then lack the holes 130 and projections 134.

Figure 9:
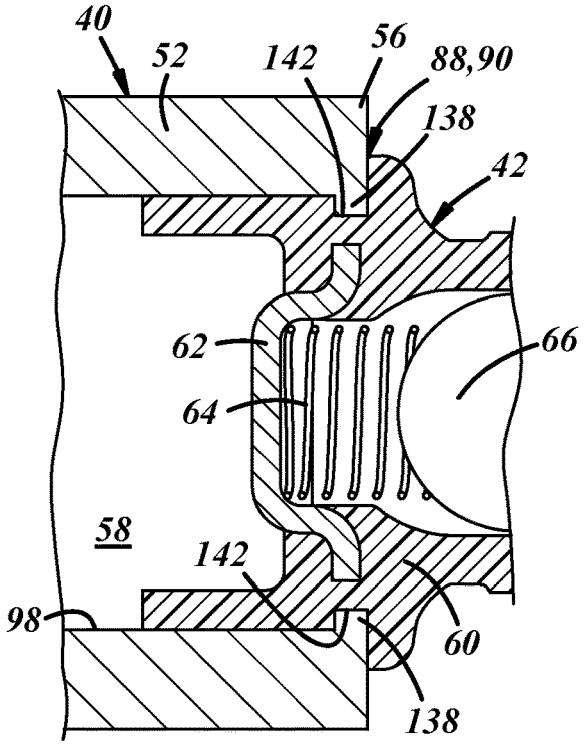
FIG. 9 is a partial sectional view of another embodiment of a valve assembly.
Figure 10:
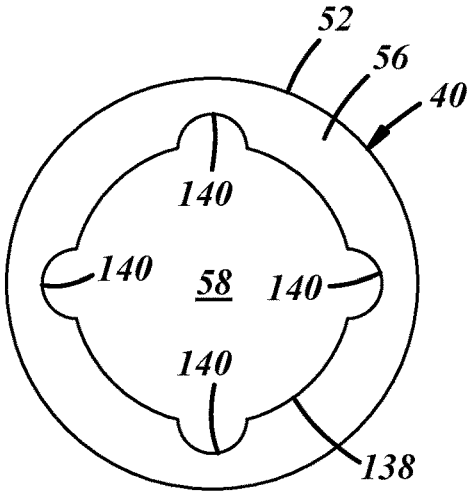
FIG. 10 is a bottom view of a metal sleeve of the valve assembly of FIG. 9.

A seventh embodiment of the integral construction 88 is depicted in FIGS. 9 and 10. In the seventh embodiment the integral construction 88 includes yet another embodiment of the overmolded construction 90. As before, the overmolded construction 90 involves the plastic base 60 of the check valve 42 and the end portion of the metal sleeve 40 adjacent the second end 56. The general steps of the overmolding process for the formation of the overmolded construction 90 are the same as previously set forth with reference to the first embodiment. In this seventh embodiment, the overmolded construction 90 includes another example of the projection-hole (or -recess) interconnection between the metal sleeve 40 and the base 60, but with the projection being a unitary extension of the metal sleeve 40. This embodiment also presents a blind design. The second end 56 of the metal sleeve 40 has a projection 138 in the form of a lip. The projection 138 is located at the terminal end of the second end 56, extends radially-inwardly (with respect to the cylindrical sleeve), and spans around the circumference of the metal sleeve 40. The projection 138 juts out beyond the inside surface 98 of the body 52 in the radially-inwardly direction. A bottom view of the metal sleeve 40 at the second end 56 is presented in isolation in FIG. 10 to more readily illustrate the projection 138. Along its circumferential extent, and as shown in FIG. 10, cutouts 140 reside in a perimeter of the projection 138. The cutouts 140 can share a surface with the inside surface 98. The cutouts 140, when provided, can ease the flow of melted plastic material around the projection 138 during the overmolding process, and once solidified assists in precluding and preventing relative circumferential movement between the metal sleeve 40 and the check valve 42. Furthermore, a recess 142 resides in the base 60. The recess 142 is formed as a consequence of the overmolding process of the base 60 and the metal sleeve 40. The recess 142 fully receives the projection 138. The projection 138 and the recess 142 preclude and prevent axial separation between the metal sleeve 40 and the check valve 42, and can preclude and prevent relative circumferential movement therebetween.

Figure 11:
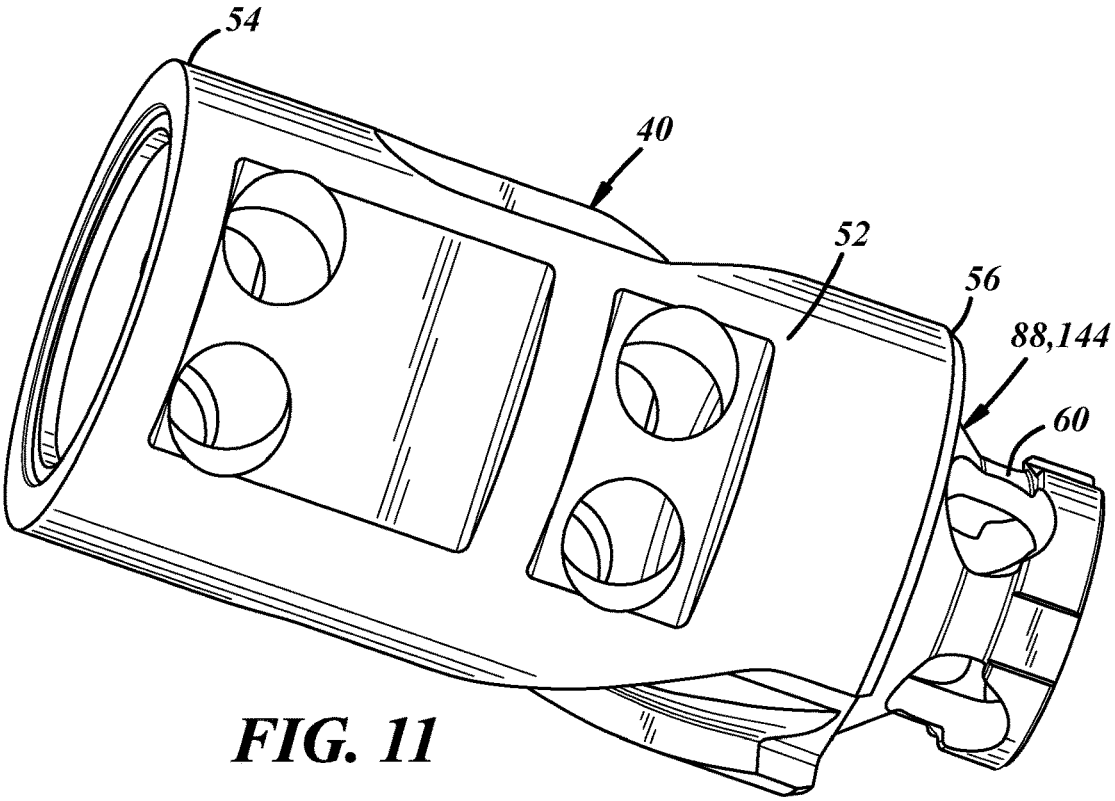
FIG. 11 is a perspective view of another embodiment of a valve assembly.

An eighth embodiment of the integral construction 88 is depicted in FIG. 11. In the eighth embodiment the integral construction 88 includes a unitary construction 144. The unitary construction 144 involves the base 60 of the check valve 42 and the end portion of the metal sleeve 40 adjacent the second end 56. Unlike embodiments described heretofore, the base 60 in this embodiment is composed of a metal material such as steel. Here, the metal material of the base 60 is the same as the metal material of the metal sleeve 40. The unitary construction 144 is constituted by the base 60 and the metal sleeve 40 having structures that are one-piece and monolithic. In other words, the base 60 and metal sleeve 40 are a single metal component. In FIG. 11, this single metal component and the unitary construction 144 are produced by metalworking and machining processes. While not shown in FIG. 11, once produced, the remaining components of the check valve 42 can then be assembled and installed with the base 60. Because the base 60 and metal sleeve 40 are a single component, there is no relative movement—axial, circumferential, or otherwise—between them.

Figure 12:
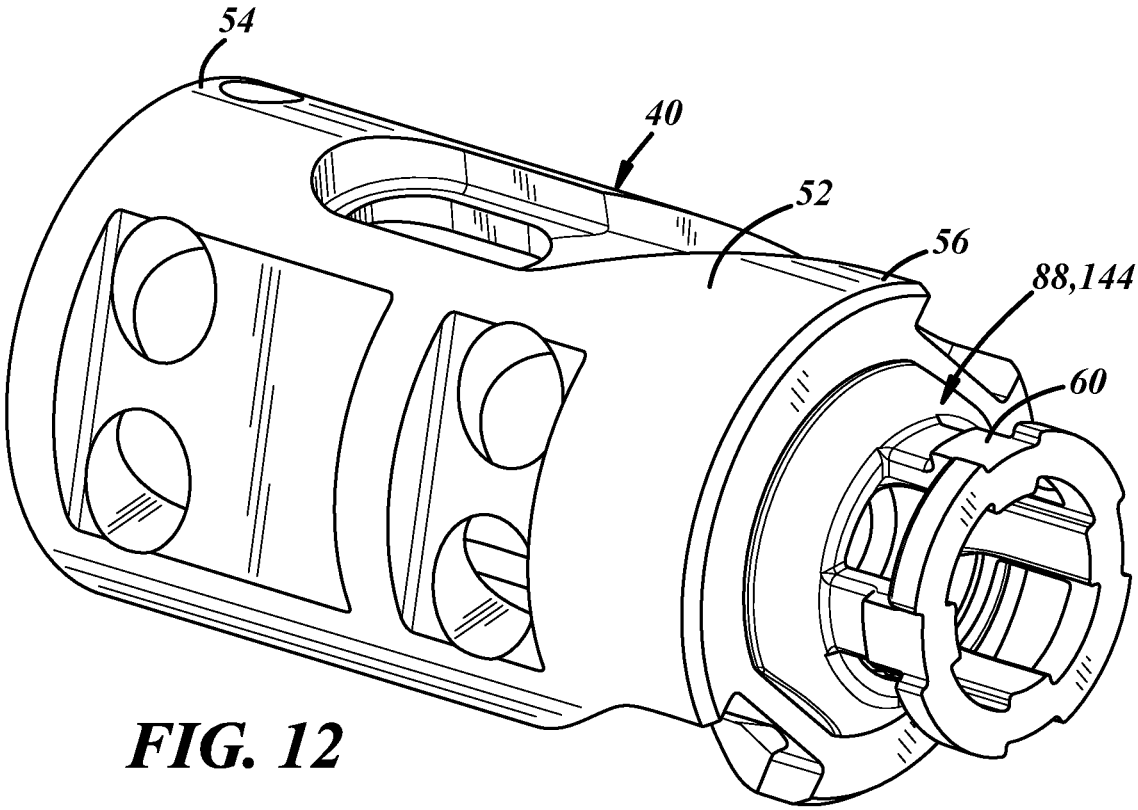
FIG. 12 is a perspective view of another embodiment of a valve assembly.

A ninth embodiment of the integral construction 88 is depicted in FIG. 12. In the ninth embodiment the integral construction 88 includes another embodiment of the unitary construction 144. As before, the unitary construction 144 involves the base 60 of the check valve 42 and the end portion of the metal sleeve 40 adjacent the second end 56. The base 60 is made of metal, and the base 60 and the metal sleeve 40 have structures that are monolithic and constitute a single metal component. In FIG. 12, the single metal component and the unitary construction 144 are produced by a metal injection molding (MIM) process. The precise MIM process steps carried out may vary in different examples depending in part upon the metal selected for use. The general steps of the MIM process for the formation of the base 60 and the metal sleeve 40 and the unitary construction 144 can include: combining metal powders with binder materials such as polymers like wax and polypropylene to produce a feedstock mix; injecting the feedstock mix in liquid state into a mold of an injection molding machine; cooling and ejecting the resulting molded (or "green") part from the mold; and removing a portion or more of the binder materials using a solvent, thermal furnaces, a catalytic process, or a combination of these methods. Still, the MIM process can include more, less, and/or different steps than presented here.

In any of the embodiments set forth thus far, as well as in other valve assemblies lacking description and depiction including those that do not have the integral construction 88, a construction can be provided that serves to pilot and index the relative angular orientation between the assembly consisting of the metal sleeve 40 and check valve 42 and the valve housing 46. The construction can further serve to assist and ensure that the valve housing's ports properly align with and fluidly communicate with the ports 48 and passageways 50 of the metal sleeve 40. The alignment and fluid communication are initially set via the construction amid assembly and installation procedures between the metal sleeve 40 and the valve housing 46, and is subsequently maintained via the construction amid use of the valve assembly 10. Moreover, the construction can serve an anti-rotation purpose and preclude and prevent movement between the metal sleeve 40 and the valve housing 46 in the circumferential direction (with respect to the generally cylindrical shapes of the sleeve and housing; i.e., rotational movement). The construction can have various designs, constructions, and components in different embodiments. A first embodiment of the construction is depicted in FIG. 2. In the first embodiment the construction includes a press-fit structural interface 146. The press-fit structural interface 146 involves an outside surface 148 of the body 52 of the metal sleeve 40 and an inner surface 150 of the valve housing 46. The metal sleeve 40 is force-fit into the interior of the valve housing 46. Surface-to-surface abutment and interference between the outside and inner surfaces 148, 150 constitutes the press-fit structural interface 146, and precludes and prevents rotational movement between the metal sleeve 40 and the valve housing 46. Furthermore, a snap ring 152 can be put in place at the first end 54 of the body 52 in order to maintain insertion of the metal sleeve 40 within the valve housing 46.

Figure 13:
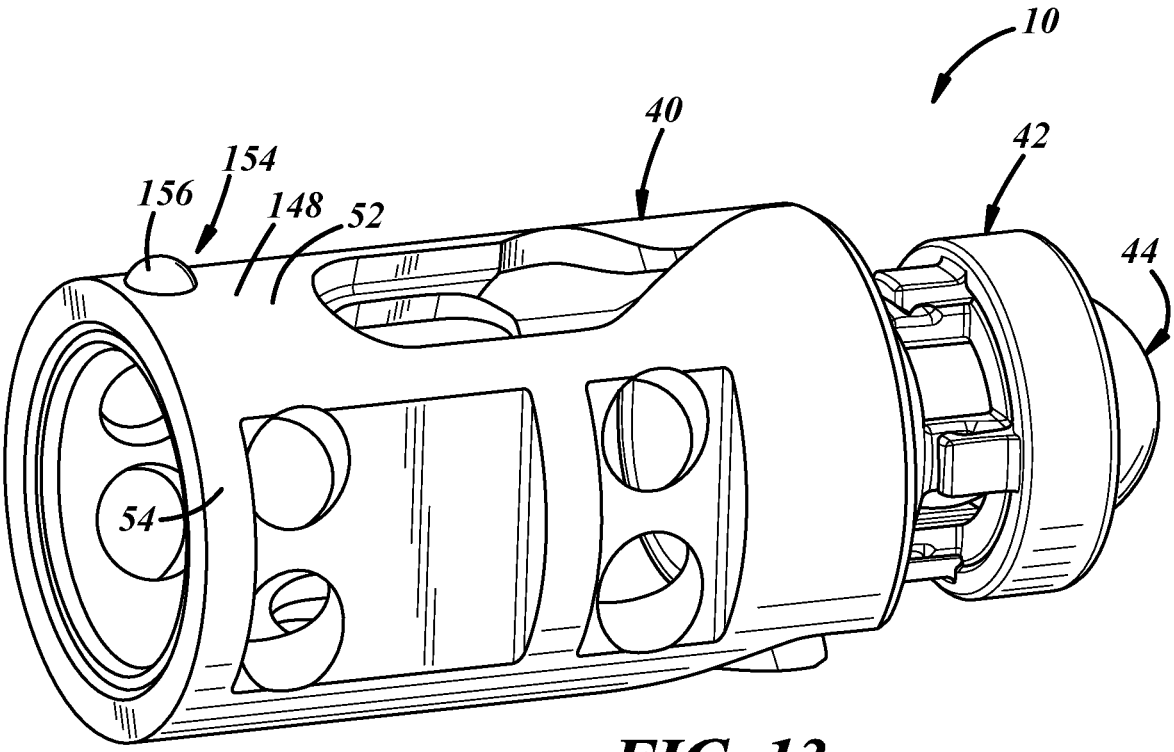
FIG. 13 is a perspective view of another embodiment of a valve assembly.

A second embodiment of the construction is depicted in FIGS. 1 and 13. In the second embodiment the construction includes a male-female mating construction 154. The male-female mating construction 154 can have various designs, constructions, and components in different embodiments. In FIGS. 1 and 13 the male-female mating construction 154 involves the metal sleeve 40 and the valve housing 46. Near the first end 54 of the body 52 of the metal sleeve 40, a ball 156 in the form of a plug ball is carried at an exterior of the metal sleeve 40. The ball 156 in this embodiment constitutes the male component of the male-female mating construction 154. The ball 156 can be composed of a metal material such as steel. The ball 156 is press-fit into a cavity 158 that is defined in the outside surface 148 of the body 52 of the metal sleeve 40. The ball 156 protrudes slightly out of the cavity 158 and radially-outwardly, leaving it exposed above the outside surface 148. For receiving insertion of the ball 156, a slot 162 resides at an interior of the valve housing 46. The slot 162 in this embodiment constitutes the female component of the male-female mating construction 154. The slot 162 is defined in the inner surface 150 of the valve housing 46 and has an axial extent beginning at the first open end 84. An entrance 164 of the slot 162 initially receives entry of the ball 156 amid the assembly and installation procedures. The slot 162 exhibits a half-moon shape in sectional profile that is complementary to the shape of the ball 156. When the ball 156 and slot 162 are fully mated, as shown in FIG. 1, the metal sleeve 40 is precluded and prevented from rotational movement relative to the valve housing 46. Absent the presence of a snap-ring 166 that can optionally be put in place as illustrated, the ball 156 and slot 162 mating may still permit relative axial movement between the metal sleeve 40 and valve housing 46. Furthermore, the location of the ball 156 on the sleeve's exterior, coupled with the location of the slot 162 at the housing's interior, angularly aligns orientation among ports and passageways between the metal sleeve 40 and the valve housing 46 to ensure proper fluid communication and exchange thereamong.

Figure 14:
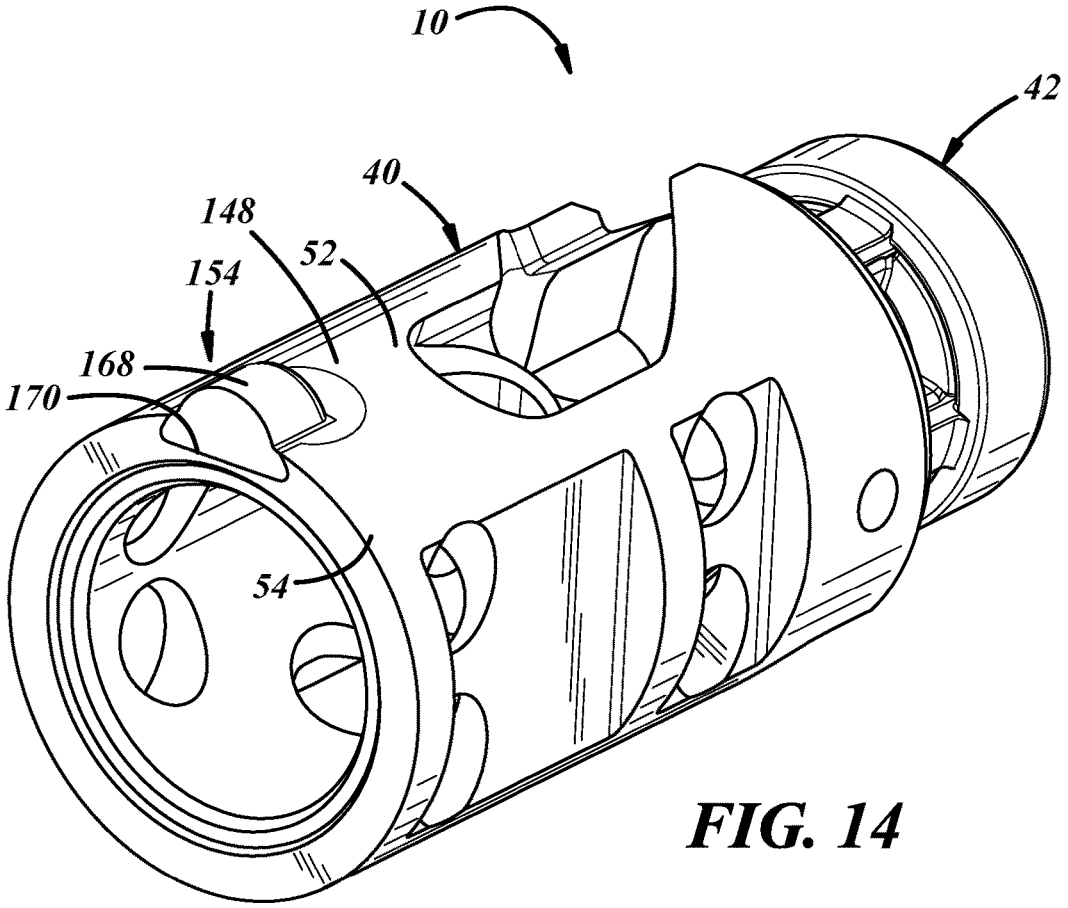
FIG. 14 is a perspective view of another embodiment of a valve assembly.

A third embodiment of the construction is depicted in FIG. 14. In the third embodiment the construction includes another embodiment of the male-female mating construction 154. As before, the male-female mating construction 154 of the third embodiment involves the metal sleeve 40 and the valve housing 46. Here, in lieu of the ball 156 of the second embodiment, an overmolded plastic tab 168 is carried at an exterior of the metal sleeve 40 and is located near or at the first end 54 of the body 52. The overmolded plastic tab 168 constitutes the male component of the male-female mating construction 154. The general steps of the overmolding process for the formation of the overmolded plastic tab 168 can be the same as previously set forth with reference to the first embodiment. The overmolded plastic tab 168 serves as the overmolded material in the overmolding process, while the metal sleeve 40 serves as the substrate in the process. A socket 170 is defined in the outside surface 148 of the body 52 of the metal sleeve 40 to accept the plastic material of the overmolded plastic tab 168 amid the overmolding process. Once solidified, the overmolded socket serves as a base of the overmolded plastic tab 168 and anchors the overmolded plastic tab 168 to the metal sleeve 40. The overmolded plastic tab 168 protrudes above the outside surface 148 and radially-outwardly with respect to the body 52, as shown in FIG. 14. Like the previous embodiment, a slot similar to the slot 162 can reside at the valve housing's interior for receiving insertion of the overmolded plastic tab 168. The shape of the slot can complement that of the overmolded plastic tab 168. When fully mated, the metal sleeve 40 is precluded and prevented from rotational movement relative to the valve housing 46. Absent the presence of a snap-ring or some other constraint that can optionally be put in place as previously illustrated, the mating between the overmolded plastic tab 168 and slot may still permit relative axial movement between the metal sleeve 40 and valve housing 46. Furthermore, the location of the overmolded plastic tab 168 on the sleeve's exterior, coupled with the location of the slot at the housing's interior, angularly aligns orientation among ports and passageways between the metal sleeve 40 and the valve housing 46 to ensure proper fluid communication and exchange thereamong.

Figure 15:
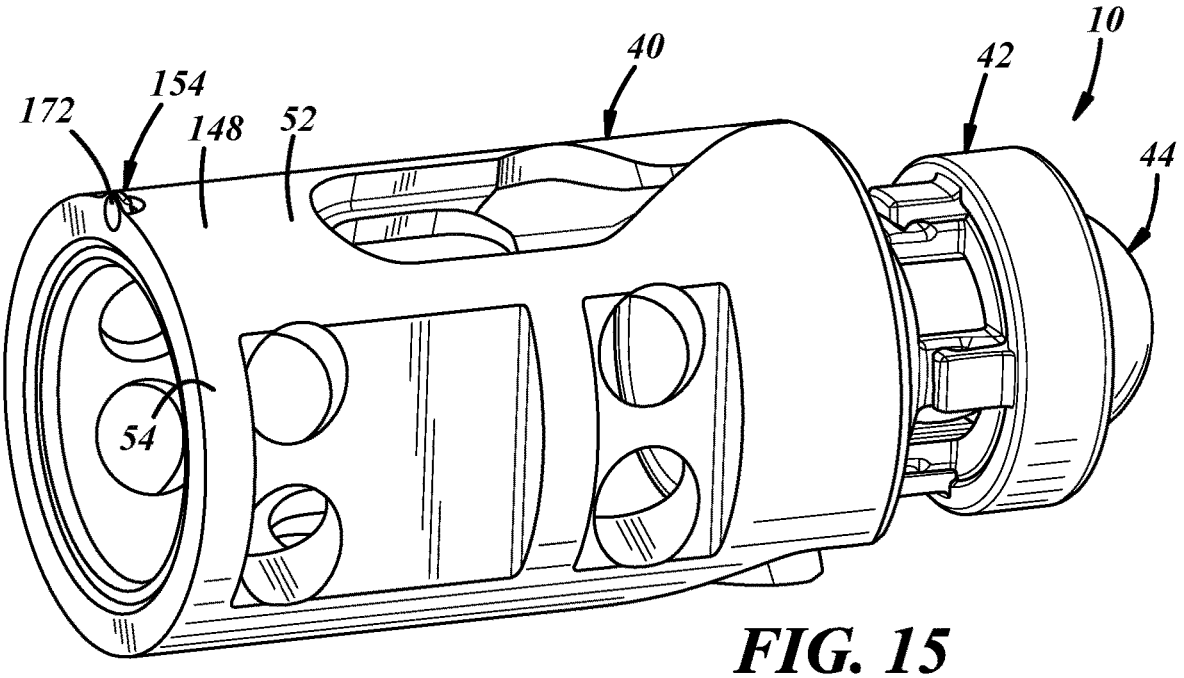
FIG. 15 is a perspective view of another embodiment of a valve assembly.

A fourth embodiment of the construction is depicted in FIG. 15. In the fourth embodiment the construction includes another embodiment of the male-female mating construction 154. As before, the male-female mating construction 154 of the fourth embodiment involves the metal sleeve 40 and the valve housing 46. A peened projection 172 is situated at an exterior of the metal sleeve 40 and located near or at the first end 54 of the body 52. The peened projection 172 constitutes the male component of the male-female mating construction 154. A peening metal working process is carried out to produce the peened projection 172. The precise peening process steps employed may vary in different examples depending in part upon the desired shape of the resulting peened projection 172. In the example of FIG. 15, the peening process can involve a mechanical cold working process that deforms the metal material of the body 52 in a desired way to form the peened projection 172. However formed, the peened projection 172 protrudes above the outside surface 148 and radially-outwardly with respect to the body 52, as shown in FIG. 15. A slot similar to the slot 162 can reside at the valve housing's interior for receiving insertion of the peened projection 172. The shape of the slot can complement that of the peened projection 172. When fully mated, the peened projection 172 and slot precludes and prevents relative rotational movement between the metal sleeve 40 and the valve housing 46. Absent the presence of an optional snap ring or some other constraint, the mating between the peened projection 172 and slot may still permit relative axial movement between the metal sleeve 40 and valve housing 46. Furthermore, the location of the peened projection 172 on the sleeve's exterior, coupled with the location of the slot at the housing's interior, angularly aligns orientation among ports and passageways between the metal sleeve 40 and the valve housing 46 to ensure proper fluid communication and exchange thereamong.

Figure 16:
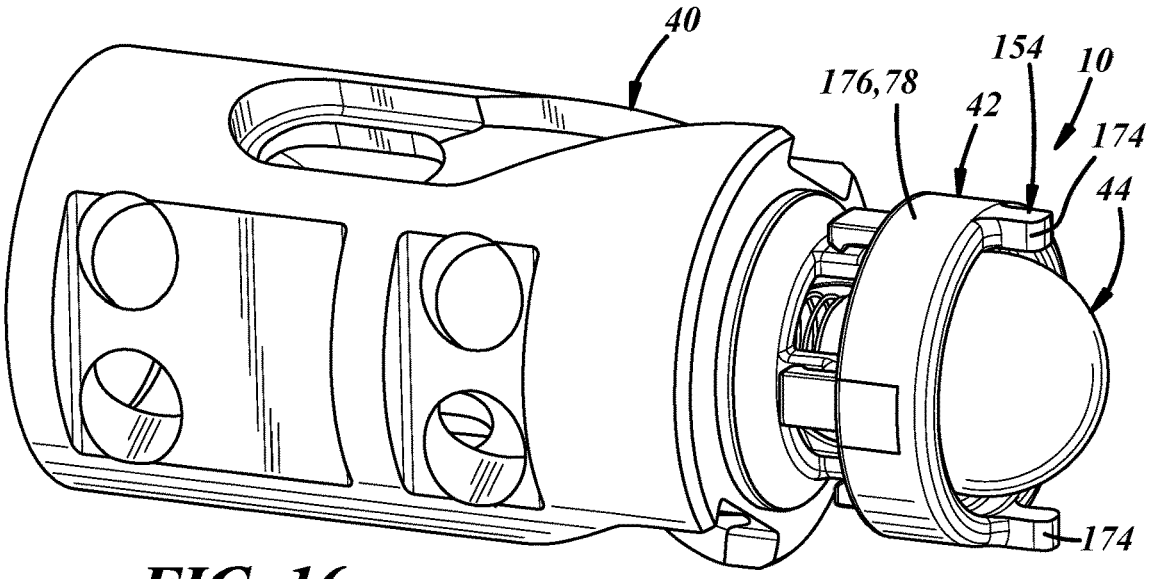
FIG. 16 is a perspective view of another embodiment of a valve assembly.

A fifth embodiment of the construction is depicted in FIG. 16. In the fifth embodiment the construction includes another embodiment of the male-female mating construction 154. Unlike previous embodiments, the male-female mating construction 154 of the fifth embodiment involves the check valve 42 and the valve housing 46. A pair of projections 174 are situated at an exterior of the check valve 42 and located adjacent the oil filter 44. The projections 174 constitute the male component of the male-female mating construction 154. The projections 174 can be unitary extensions of a frame 176 of the check valve 42 or of the frame 78 of the oil filter 44. As illustrated in FIG. 16, the projections 174 can extend in the axial direction. A pair of slots reside at the valve housing's interior for receiving insertion of the projections 174. The shape and location of each slot can complement those of the projections 174. When mated, the projections 174 and slots preclude and prevent relative rotational movement between the check valve 42 and hence the metal sleeve 40, and the valve housing 46. Absent the presence of an optional constraint, the mating between the projections 174 and slots may still permit relative axial movement between the check valve 42 and metal sleeve 40 and the valve housing 46. Furthermore, the location of the projections 174 at the check valve's exterior, coupled with the location of the slots at the housing's interior, angularly aligns orientation among ports and passageways between the metal sleeve 40 and the valve housing 46 to ensure proper fluid communication and exchange thereamong.

Figure 17:
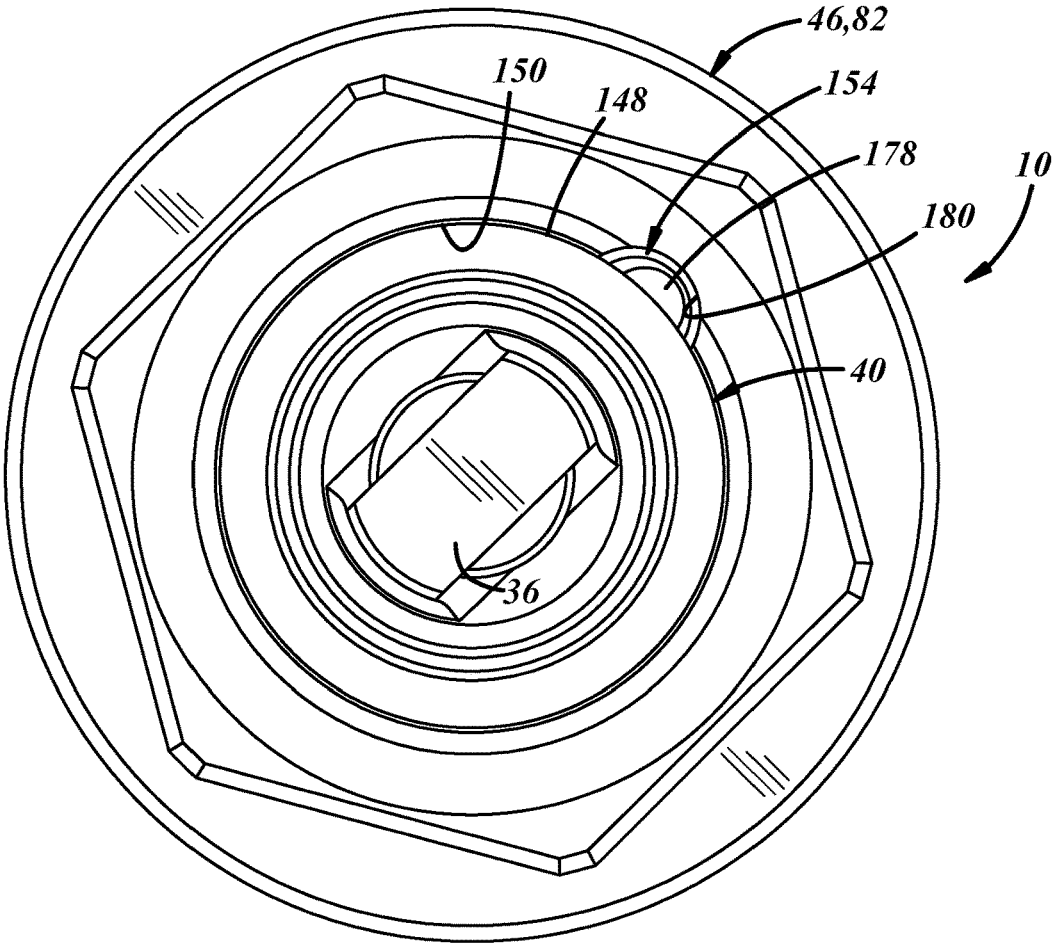
FIG. 17 is a front view of another embodiment of a valve assembly.

A sixth embodiment of the construction is depicted in FIG. 17. In the sixth embodiment the construction includes another embodiment of the male-female mating construction 154. As before, the male-female mating construction 154 of the sixth embodiment involves the metal sleeve 40 and the valve housing 46. A ball or pin 178 is situated at an exterior of the metal sleeve 40. The ball or pin 178 constitutes the male component of the male-female mating construction 154. The ball or pin 178 can be made of a metal material such as steel, and can be set in place via a staking process or another way. As illustrated in the front view of FIG. 17, the ball or pin 178 protrudes above the outside surface 148 and radially-outwardly with respect to the body 52. For receiving insertion of the ball or pin 178, a slot 180 resides at an interior of the valve housing 46. The slot 180 in this embodiment constitutes the female component of the male-female mating construction 154. The slot 180 is defined in the inner surface 150 of the valve housing 46 and can have an axial extent beginning at the first open end 84. The slot 180 has a shape that complements that of the ball or pin 178. When mated, the ball or pin 178 and slot 180 preclude and prevent relative rotational movement between the metal sleeve 40 and the valve housing 46. Absent the presence of an optional constraint, the mating between the ball or pin 178 and slot 180 may still permit relative axial movement between the metal sleeve 40 and the valve housing 46. Furthermore, the location of the ball or pin 178 at the sleeve's exterior, coupled with the location of the slot 180 at the housing's interior, angularly aligns orientation among ports and passageways between the metal sleeve 40 and the valve housing 46 to ensure proper fluid communication and exchange thereamong. Still, in other embodiments the ball or pin 178 could be situated at the valve housing's interior, with the accompanying slot 180 situated at the sleeve's exterior.

Furthermore, in the embodiments of the male-female mating construction 154, the male components and female components can be interchanged with each other without hampering the preclusion and prevention of rotational movement, and without thwarting the alignment of angular orientation.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A variable camshaft timing (VCT) valve assembly, comprising:

a metal sleeve extending axially between a pair of ends;

a check valve having a base, the base located at one of the pair of ends of the metal sleeve, and the base having an integral construction with the one of the pair of ends of the metal sleeve, wherein the base is composed of a plastic material, the integral construction includes an overmolded construction of the base with the metal sleeve;

a valve housing at least partially enclosing the metal sleeve and the check valve; and a male-female mating construction between the valve housing and the metal sleeve, the male-female mating construction precluding relative circumferential rotational movement between the valve housing and the metal sleeve.

2. The variable camshaft timing (VCT) valve assembly as set forth in claim 1, wherein the overmolded construction includes at least one projection received in at least one recess or a hole.

3. The variable camshaft timing (VCT) valve assembly as set forth in claim 1, wherein the integral construction includes an overmolded construction of the base with the metal sleeve and an interlocking groove between the base and the metal sleeve.

4. The variable camshaft timing (VCT) valve assembly as set forth in claim 1, wherein the check valve further has a retainer against which a spring of the check valve is urged, the retainer is carried by the base.

5. The variable camshaft timing (VCT) valve assembly as set forth in claim 4, wherein the integral construction includes a metal-worked construction between the one of the pair of ends of the metal sleeve and the retainer.

6. The variable camshaft timing (VCT) valve assembly as set forth in claim 4, wherein the integral construction includes the retainer having an end portion that is press-fit into a bore of the metal sleeve at the one of the pair of ends.

7. The variable camshaft timing (VCT) valve assembly as set forth in claim 1, wherein the integral construction includes the one of the pair of ends of the metal sleeve having a metal-worked construction that captures the check valve.

8. The variable camshaft timing (VCT) valve assembly as set forth in claim 1, wherein the integral construction includes at least one hole or recess residing in a wall of the metal sleeve and at least one overmolded projection of the base received in the at least one hole or recess.

9. The variable camshaft timing (VCT) valve assembly as set forth in claim 8, wherein the wall is a side wall of the metal sleeve.

10. The variable camshaft timing (VCT) valve assembly as set forth in claim 8, wherein the wall is an end wall of the metal sleeve.

11. The variable camshaft timing (VCT) valve assembly as set forth in claim 1, wherein the base is composed of a metal material, and the integral construction includes the base having a unitary construction with the metal sleeve.

12. The variable camshaft timing (VCT) valve assembly as set forth in claim 1, wherein the male-female mating construction includes a ball carried at an exterior of the metal sleeve and a slot residing at an interior of the valve housing, receipt of the ball in the slot precludes relative circumferential rotational movement between the valve housing and the metal sleeve.

13. The variable camshaft timing (VCT) valve assembly as set forth in claim 1, wherein the male-female mating construction includes an overmolded plastic tab of the metal sleeve and a slot residing at an interior of the valve housing, receipt of the overmolded plastic tab in the slot precludes relative circumferential rotational movement between the valve housing and the metal sleeve.

14. The variable camshaft timing (VCT) valve assembly as set forth in claim 1, wherein the male-female mating construction includes a peened projection of the metal sleeve.

15. A variable camshaft timing (VCT) phaser assembly comprising the variable camshaft timing (VCT) valve assembly of claim 1, the variable camshaft timing (VCT) valve assembly further comprising an oil filter assembly coupled to the check valve, and a center bolt at least partially enclosing the metal sleeve and the check valve.

16. A valve assembly, comprising:

a metal sleeve having a bore spanning axially between a first end and a second end;

a check valve located at one of the first or second ends of the metal sleeve, the check valve having a base, the base being composed of a plastic material;

an overmolded construction incorporating the plastic material of the base;

a valve housing at least partially enclosing the metal sleeve and the check valve; and a male-female mating construction between the valve housing and the metal sleeve, the male-female mating construction precluding relative circumferential rotational movement between the valve housing and the metal sleeve.

17. The valve assembly as set forth in claim 16, wherein the overmolded construction includes at least one projection received in at least one recess or a hole.

18. The valve assembly as set forth in claim 16, wherein the overmolded construction includes an interlocking groove between the base and the metal sleeve.

19. The valve assembly as set forth in claim 16, further comprising a roll-formed construction between the metal sleeve and the check valve.

20. The valve assembly as set forth in claim 16, wherein the male-female mating construction includes a ball of the metal sleeve and a slot of the valve housing, receipt of the ball in the slot precludes relative circumferential rotational movement between the valve housing and the metal sleeve.

21. The valve assembly as set forth in claim 16, wherein the male-female mating construction includes an overmolded plastic tab of the metal sleeve and a slot of the valve housing, receipt of the overmolded plastic tab in the slot precludes relative circumferential rotational movement between the valve housing and the metal sleeve.

22. A variable camshaft timing (VCT) valve assembly, comprising:

a metal sleeve having a first end and a second end, and having a ball carried at an exterior of the metal sleeve adjacent the first end;

a check valve located at the second end of the metal sleeve, the check valve having a base, the base being composed of a plastic material;

an overmolded construction of the base with the metal sleeve, the overmolded construction including an interlocking groove between the base and the metal sleeve; and a center bolt at least partially enclosing the metal sleeve and the check valve, the center bolt having a slot residing at an interior thereof, receipt of the ball of the metal sleeve in the slot precluding relative circumferential rotational movement between the center bolt and the metal sleeve.

23. A variable camshaft timing (VCT) valve assembly, comprising:

a metal sleeve;

a spool, received within the metal sleeve, that controls fluid flow through the metal sleeve;

a check valve located at an end of the metal sleeve;

a valve housing at least partially enclosing the metal sleeve and the check valve; and a male-female mating construction between the valve housing and the metal sleeve, the male-female mating construction precluding relative circumferential rotational movement between the valve housing and the metal sleeve.

24. The variable camshaft timing (VCT) valve assembly as set forth in claim 23, wherein the male-female mating construction includes a ball of the metal sleeve and a slot of the valve housing, receipt of the ball in the slot precludes relative circumferential rotational movement between the valve housing and the metal sleeve.

25. The variable camshaft timing (VCT) valve assembly as set forth in claim 23, wherein the male-female mating construction includes an overmolded plastic tab of the metal sleeve and a slot of the valve housing, receipt of the overmolded plastic tab in the slot precludes relative circumferential rotational movement between the valve housing and the metal sleeve.

26. The variable camshaft timing (VCT) valve assembly as set forth in claim 23, wherein the male-female mating construction includes a peened projection of the metal sleeve.

27. A variable camshaft timing (VCT) valve assembly, comprising:

a metal sleeve extending axially between a pair of ends;

a check valve having a base, the base located at one of the pair of ends of the metal sleeve, and the base having an integral construction with the one of the pair of ends of the metal sleeve; and a valve housing at least partially enclosing the metal sleeve and the check valve, wherein the metal sleeve has a press-fit structural interface with the valve housing, the press-fit structural interface precluding relative circumferential rotational movement between the valve housing and the metal sleeve.

28. A variable camshaft timing (VCT) valve assembly, comprising:

a metal sleeve extending axially between a pair of ends;

a check valve having a base, the base located at one of the pair of ends of the metal sleeve, and the base having an integral construction with the one of the pair of ends of the metal sleeve;

a valve housing at least partially enclosing the metal sleeve and the check valve; and a male-female mating construction between the valve housing and the check valve, the male-female mating construction precluding relative circumferential rotational movement between the valve housing and the check valve.

* * * * *